US006453694B1

(12) United States Patent
Trulaske, Sr.

(10) Patent No.: US 6,453,694 B1
(45) Date of Patent: Sep. 24, 2002

(54) AIR CURTAIN HORIZONTAL MERCHANDISER

(75) Inventor: Robert J. Trulaske, Sr., St. Louis, MO (US)

(73) Assignee: True Manufacturing Co. Inc., O'Fallon, MO (US)

( * ) Notice: Subject to any disclaimer, the term of this patent is extended or adjusted under 35 U.S.C. 154(b) by 0 days.

(21) Appl. No.: 10/006,278

(22) Filed: Dec. 4, 2001

Related U.S. Application Data

(60) Provisional application No. 60/251,152, filed on Dec. 4, 2000.

(51) Int. Cl.[7] ..... A47F 3/04

(52) U.S. Cl. ..... 62/249; 62/256; 312/128

(58) Field of Search ..... 62/256, 255, 246, 62/249; 312/128, 116; 454/193

(56) References Cited

U.S. PATENT DOCUMENTS 2,175,839 A * 10/1939 Hopkins ..... 62/246
2,273,233 A * 2/1942 Tanner ..... 312/128
2,463,614 A * 3/1949 Hardin ..... 312/116
2,641,112 A * 6/1953 Muffly ..... 312/117
2,911,799 A * 11/1959 Guyton et al. ..... 62/248
2,967,404 A * 1/1961 Detwiler ..... 62/246
3,314,250 A * 4/1967 Weber ..... 221/150 HC
3,324,783 A * 6/1967 Hickox ..... 454/193
4,723,414 A * 2/1988 Hurutachi et al. ..... 62/155
5,297,863 A * 3/1994 Richardson et al. ..... 211/153
5,688,034 A * 11/1997 Kojima ..... 211/175
5,848,534 A * 12/1998 Stauffer ..... 312/31.01
6,032,475 A * 3/2000 Tolfsen ..... 62/256

* cited by examiner

*Primary Examiner*—William E. Tapolcai
(74) *Attorney, Agent, or Firm*—Polster, Lieder Woodruff & Lucchesi

(57) ABSTRACT

This merchandiser (10) with horizontal air curtain includes an insulated product compartment (11) having an open access top (20); an evaporator compartment (22) for cooling air supplied from a fan compartment (26) and an air circulation system (25) having an upper outlet (40) at one side of the product compartment (11), an upper inlet at the other side of the product compartment disposed across from the outlet (40) and air circulation passages (30) and (32) communicating between the inlet (42) and the fan compartment (26). The outlet (40) discharges air from the evaporator compartment (22) into the return air inlet (42) and the inlet (42) returns air to the fan compartment (26) to provide a continuous air curtain for protecting the product compartment (11) from the incursion of ambient air so that the product (B) is maintained in a cool condition. The product compartment (11) includes a holding rack (48) adapted to hold single depth rows of partitioned vertical columns of bottles (B).

12 Claims, 6 Drawing Sheets

AIR CURTAIN HORIZONTAL MERCHANDISER

CROSS REFERENCE TO RELATED APPLICATION

This application claims priority to Provisional Appl. Ser. No. 60/251,152 filed on Dec. 4, 2000.

BACKGROUND OF THE INVENTION

This invention relates generally to refrigerator units for food and beverage product of the type known as merchandisers, and particularly to a merchandiser of a convenient small size having a horizontal air curtain for maintaining the product at a desired temperature.

Refrigerator units having a storage cabinet have been used in supermarkets and other public facilities for many years. Such units are usually provided with a sliding cover which must be opened to access frozen product stored within the cabinet. Alternatively, units having an open top are known which provide a layer of cold air on the product. Such units, which provide direct access to the product are revealed in U.S. Pat. No. 2,446,686 and U.S. Pat. No. 2,463,104.

An early system which provides a cooling cycle and a defrost cycle is shown in U.S. Pat. No. 3,425,236 which discloses a refrigerating system with an air control system which passes air over the top of product as part of a cooling cycle and returns air as part of a defrost cycle using an air by-pass system.

A later development is that known as an air curtain refrigerated unit which is represented by U.S. Pat. No. 5,675,983. This patent discloses a refrigerated case having an upper display for food products at a temperature above freezing and a lower display for products at a temperature below freezing. The upper display is maintained in a cool condition by a vertical airstream; the lower display is maintained in a cold condition by an air stream projected across the access opening.

None of the units described in the reference patents is intended to provide easy access to a beverage container of relatively small size which maintains product at a temperature above freezing with easy access to the consumer.

The present merchandiser air curtain system overcomes these problems in a manner not revealed in the known prior art.

SUMMARY OF THE INVENTION

This merchandiser is arranged to provide a horizontal air curtain which passes over the product to maintain the product in a cool but not frozen condition. The relatively small size unit has an open top which provides ready access to customers who can reach into the merchandiser and retrieve product without discomfort since product is maintained in a cooled rather than a frozen condition and the air curtain is maintained at a suitable temperature to avoid discomfort to a customer reaching through it.

This merchandiser with horizontal air curtain comprises an insulated product compartment having an open access top; an evaporator compartment having an evaporator therein; a compressor compartment having a compressor therein, supplying refrigerant to the evaporator; and a fan compartment having a fan therein and communicating with the evaporator compartment. An air circulation means is provided having an upper discharge outlet at one side of the product compartment communicating with the evaporator compartment and an upper return inlet at the other side of the product compartment across from the upper outlet and an air circulation passage. The air circulation passage has opposed ends, one end communicating with the inlet and the other end communicating with the fan compartment. The outlet discharges cool air from the evaporator compartment into the return inlet to provide a constant stream of circulating air across the top of the product compartment when the fan is operating, sufficient to provide an air curtain insulating the product compartment from ambient air and maintain the product in a cool condition.

It is an aspect of the invention to provide that the product compartment includes a front wall, a rear wall, opposed end walls and a bottom wall, the distance between the front and rear walls being substantially less than the distance between the end walls. It is another aspect of this invention to provide that the distance between the front and rear walls is about one half of the distance between the end walls.

It is yet another aspect of the invention to provide that the evaporation compartment includes a vertical panel adjacent the rear wall having a plurality of vents defining the upper outlet.

It is still another aspect of the invention to provide that the air circulation passage includes a vertical panel disposed adjacent the front wall and having a plurality of perforations defining the upper inlet.

It is another aspect of the invention to provide that the air circulation passage includes a horizontal panel disposed adjacent the bottom wall.

It is an aspect of this invention to provide that a product holding rack adapted to receive bottle containers is disposed in said insulated product compartment including a plurality of vertical partitions.

It is another aspect of the invention to provide that the vertical partitions are provided by grills held in spring biased relation within said product compartment.

It is yet another aspect of the invention to provide that the product holding rack includes an inclined grill for holding bottle containers in inclined relation within said product compartment.

It is still another aspect of the invention to provide that the product holding rack includes a vertical U-shaped grill disposed adjacent said rear wall and having an opening providing access to said fan compartment.

It is an aspect of the invention to provide that a product holding rack is disposed in said insulated product compartment adapted to hold a plurality of vertical columns of bottles in single depth rows inclined to the horizontal to facilitate customer removal.

This horizontal air curtain merchandiser is relatively simple to manufacture, easy to maintain and replenish and efficient in operation.

DESCRIPTION OF THE PREFERRED EMBODIMENT

Figure 1:
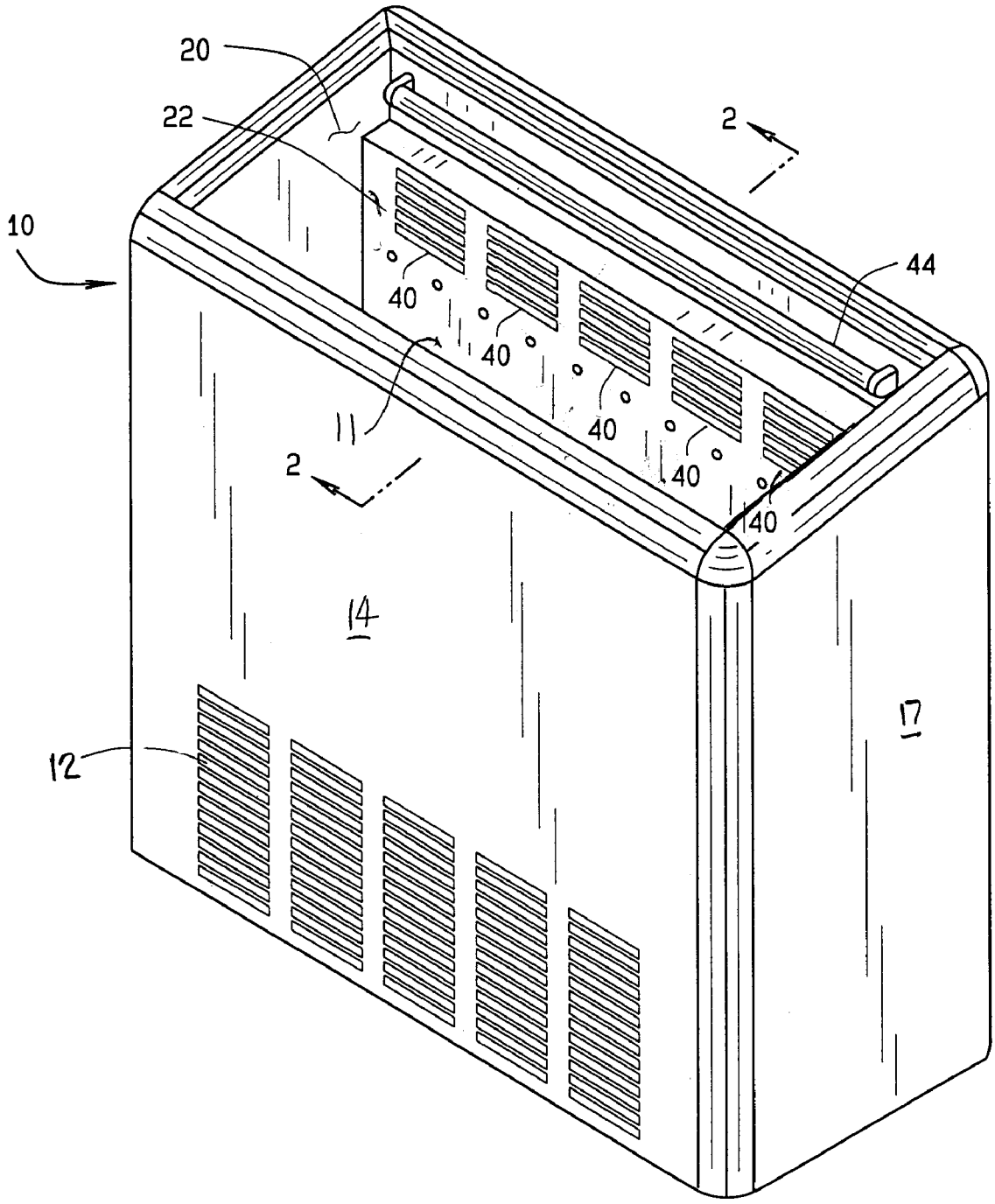
FIG. 1 is a perspective view of the merchandiser.

Referring now by reference numerals to the drawings and first to FIGS. 1–4, it will be understood that the merchandiser 10 is of the type that may be used in supermarkets in the checkout area, for example. Vertical air curtain merchandiser have been used for many years in this location. This merchandiser provides a horizontal air curtain, however, and is small enough, about 3 ft wide by 1.5 ft deep and 3 ft tall (less than 1.0 m×0.5 m×1.0 m) to be accommodated in a small area adjacent the checkout counter.

Figure 2:
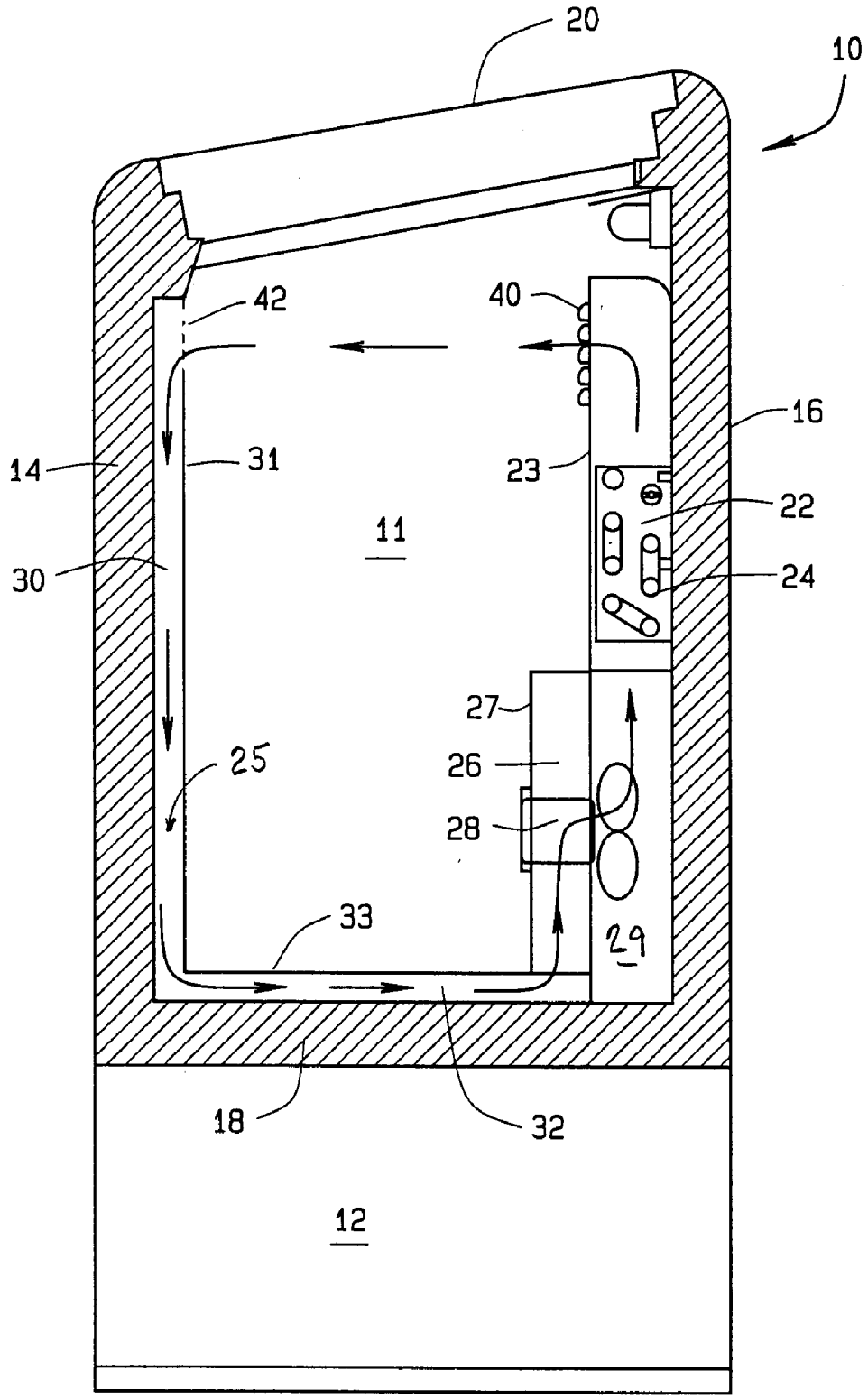
FIG. 2 is a cross-sectional view taken on Line 2—2 of FIG. 1 showing the merchandiser unloaded.
Figure 3:
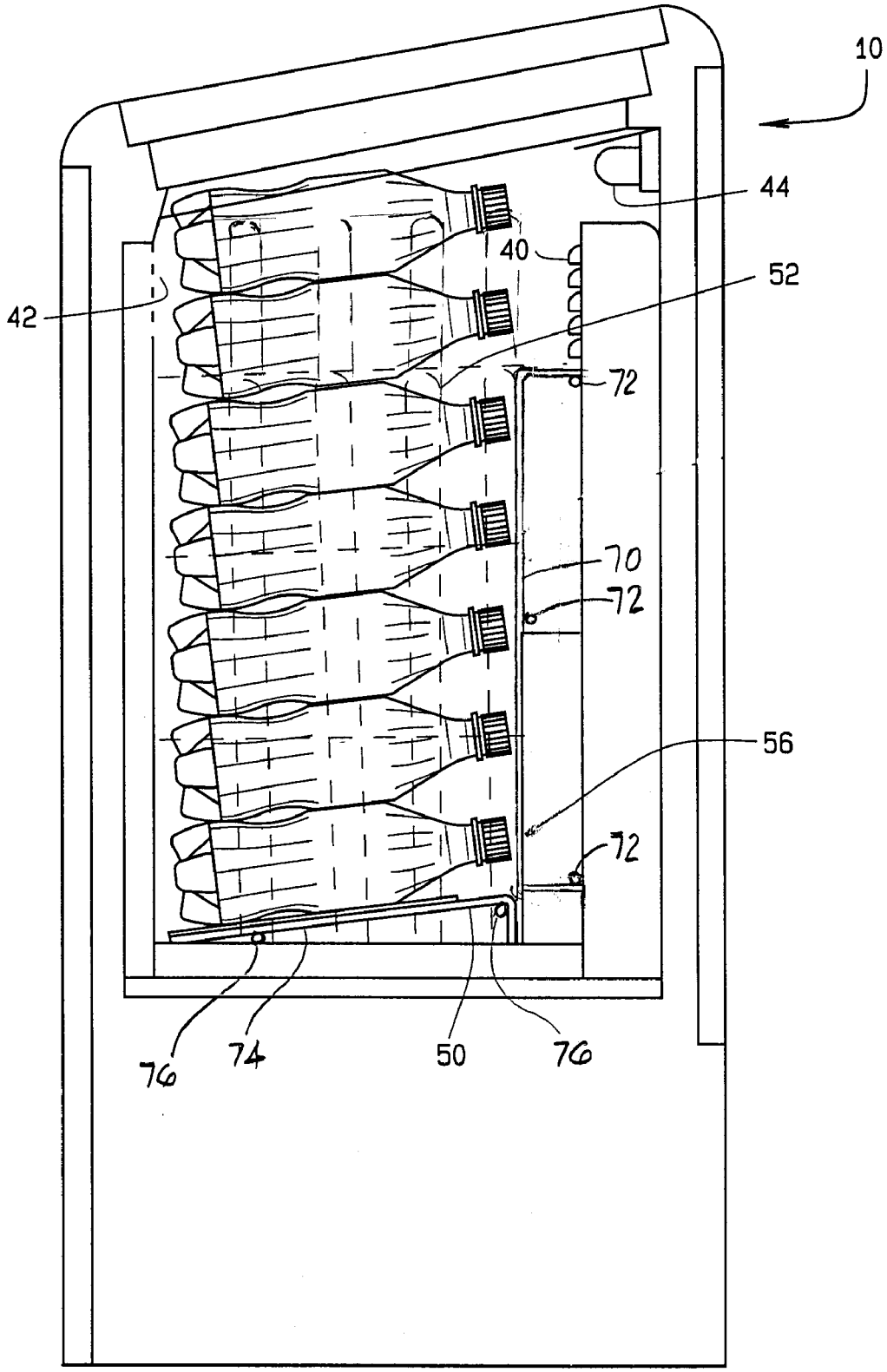
FIG. 3 is a similar view to FIG. 2 showing the merchandiser loaded with beverage containers.
Figure 4:
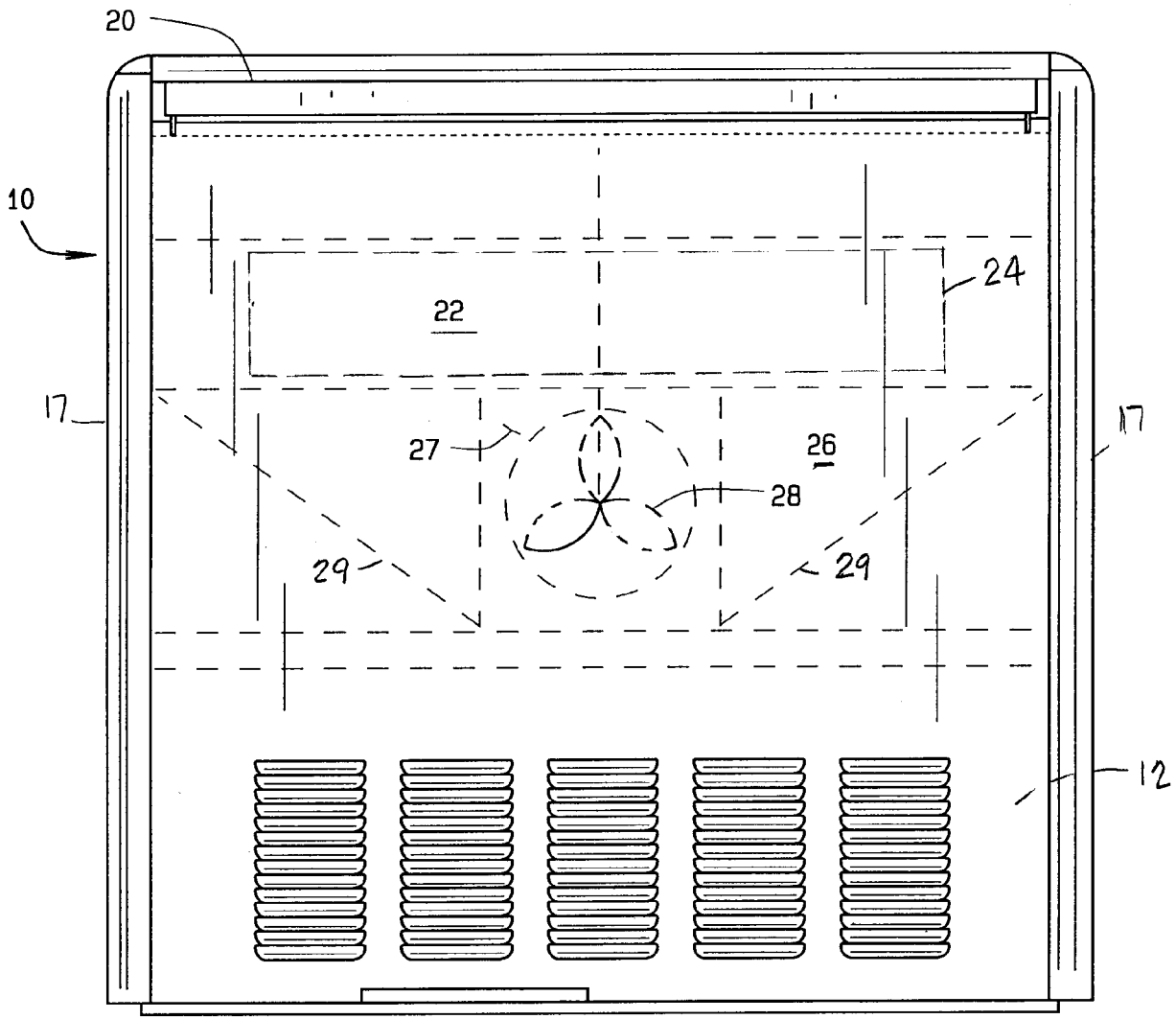
FIG. 4 is a front elevational view of the merchandiser.

More particularly, and as best shown in FIGS. 1 and 2, the merchandiser 10 includes insulated front and rear walls 14 and 16, end walls 17 and an insulated bottom wall 18. The insulated walls cooperate to provide an insulated beverage compartment 11 above a compressor compartment 12, having an open top 20 in the operating condition. Adjacent rear wall 16 is an evaporator compartment 22 defined by a panel 23 and the rear wall 16 and housing an evaporator 24. The evaporator 24 is supplied with refrigerant from a compressor (not shown) housed in the compressor compartment 12. Adjacent the lower end of the evaporator compartment 22 is a fan compartment 26 which is defined by a panel 27 and houses a fan 28 which is mounted between panels 23 and 27. Adjacent the front wall 14 and the bottom wall 18 are air circulation passages 30 and 32, defined by panels 31 and 33, respectively, which communicate with the fan compartment 26. The upper portion of rear panel 23 includes a plurality of vents 40 and the upper portion of front panel 31 includes a plurality of perforations 42 across from the vents 40. A fluorescent light 44 is provided. In the embodiment shown, the product is beverage bottle containers.

Figure 7:
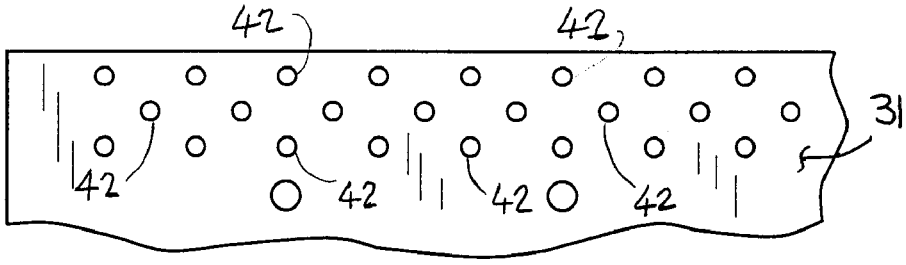
FIG. 7 is a fragmentary view taken on Line 7—7 of FIG. 5.

When the fan 28 is activated, air is drawn into the evaporator compartment 22 from the circulation passages 30 and 32, which cooperate with the discharge vents 40 and return air inlets to provide an air circulation system 25, and distributed to the lengthwise extending evaporator coils by inclined plates 29 below. the evaporator compartment. The cooled air is directed by the vents 40 across the upper end of the beverage bottle containers compartment 11, and into the vertical and horizontal, circulation passages 30 and 32 by virtue of the perforations 42 in the panel 31 located directly across from the vents 40. The perforations 42, in the embodiment shown, extend along the length of the upper portion of panel 31, as shown in FIG. 7, and are of a diameter and number to receive the air being discharged from the vents 40 in a smooth continuous flow of circulating air. The circulation of the air is thus completed and a continuous horizontal curtain of cooled air maintains the beverage bottle containers at an appropriate temperature and prevents relatively warm ambient air from entering the product storage compartment and, in effect, completes the insulation system.

Figure 5:
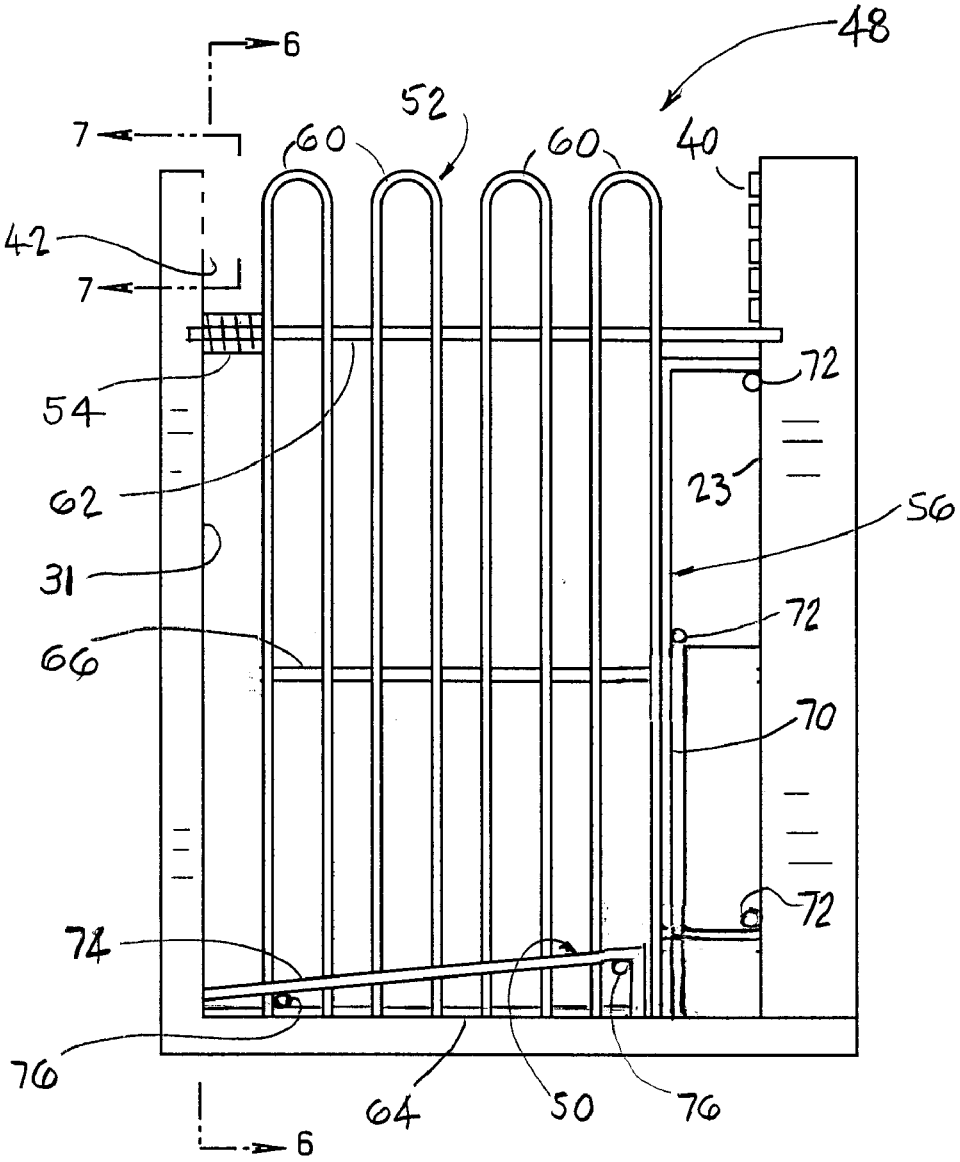
FIG. 5 is a cross-sectional view showing the beverage support rack.
Figure 6:
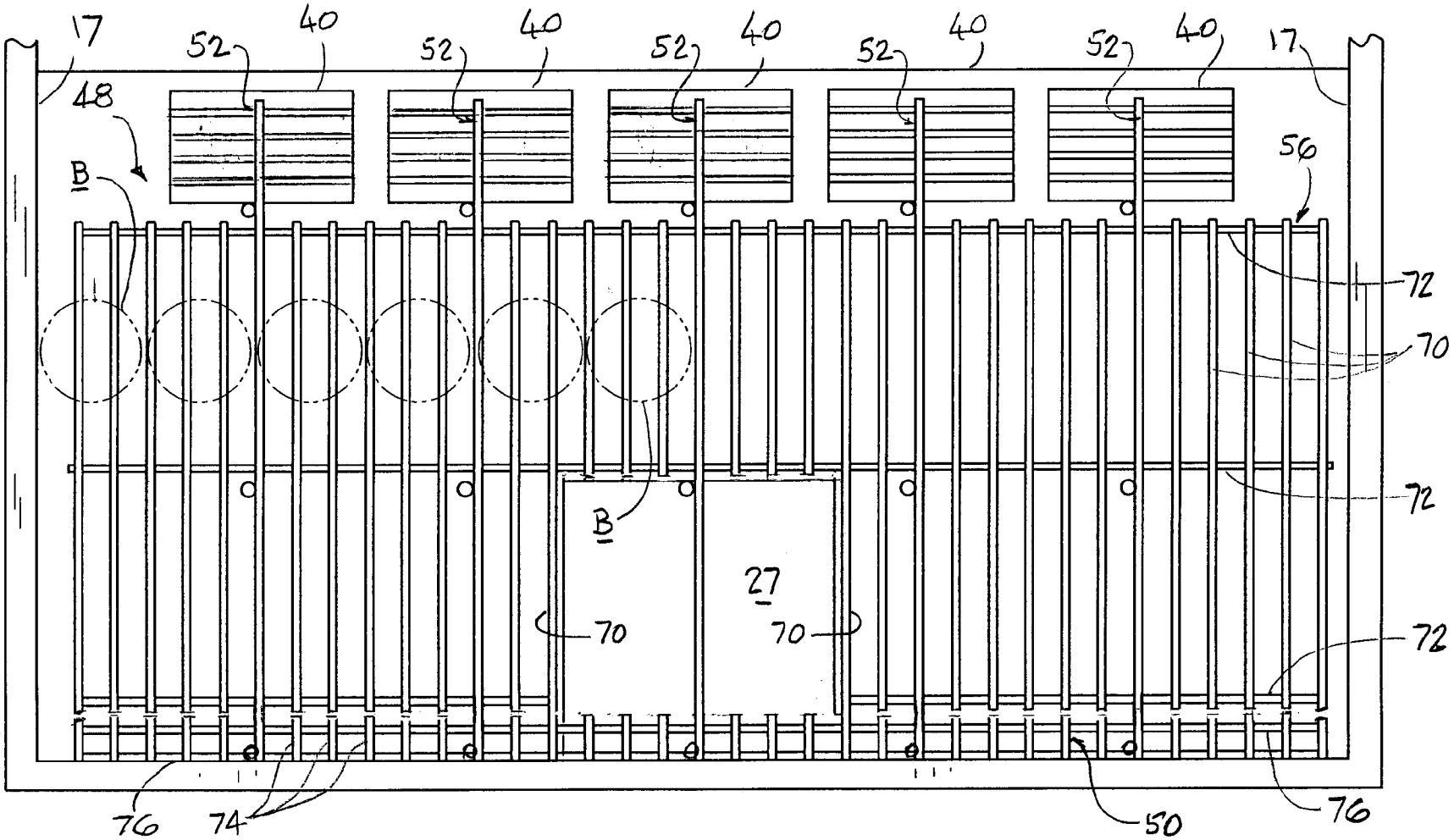
FIG. 6 is a longitudinal section taken on Line 6—6 of FIG. 5.

In the embodiment shown, see in particular FIGS. 5 and 6, a product holding rack 48 is provided which includes a plurality of sub-compartments holding the beverage containers B is provided by wire grills which include an inclined beverage seating grill 50, a plurality of vertical partition grills 52, and a rear U-shaped grill 56 which cooperate to hold the container bottles in place and constitute an efficient storage rack. Typically, six storage sub-compartments may hold up to fourteen double column bottles each, resulting in an overall capacity of eighty-four bottles. The small size, but easy access and relatively large capacity storage compartment, allows for easy inventory control by store personnel and maintains the beverage containers B, for example, 20 ounce soft drink bottles, in a cool condition.

The partition grills 52 extend between the front and rear panels 31 and 23 and include vertical inverted U-shaped pieces 60 connected by transverse upper, lower and intermediate members 62, 64 and 66, respectively, welded or otherwise attached thereto. At least the upper members 62 include outwardly extending portions which are a received in openings provided in the front and rear panels 31 and 23. Additionally, a compression spring 54 may be provided between partitions 52 and the front panel 31 to assist in holding the grills 52 in place. The rear U-shaped grill 56, as shown in FIGS. 5 and 6 includes transverse members indicated by numerals 70 connected by longitudinal members 72. The grill 56 may be welded or otherwise attached to the panel 23. In order to facilitate access to the fan 28 for servicing the members 70 and 72 may be cut short around the fan compartment.

It will be understood that the lower, seating grill 50, which includes L-shaped transverse members 74 connected by longitudinal members 76, provides for inclined storage of the bottles B which facilitates bottle storage and removal.

Because of the open top, the inclined positioning of the bottles B, the spacing of the cap end of the bottles from the U-shaped grill 56, and the relatively narrow single container depth of the bottles, it is a simple matter for a customer to reach into the merchandiser, select a beverage of choice and grasp it by the neck for easy removal. This is done without discomfort because the air curtain airstream is relatively slow moving and is maintained only at a sufficient temperature to keep the beverage cool.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense.

I claim:

1. A merchandiser with horizontal air curtain comprising:

an insulated product compartment having an open access top and including a front wall, a rear wall, apposed end walls and a bottom wall, the distance between the front and rear walls being sufficiently short to accommodate only a single depth row of containers and being substantially less than the distance between the access opening and the bottom wall;

an evaporator compartment having a compressor therein;

a compressor compartment having a compressor therein, supplying refrigerant to the evaporator;

a fan compartment having a fan therein and communicating with the evaporator compartment; and air circulation means having an upper outlet at one side of the product compartment communicating with the evaporator compartment and an upper inlet at the other side of the product compartment across from the upper outlet and an air circulation passage having opposed ends one end communicating with the inlet and the other end communicating with the fan compartment; the outlet discharging cool air from the evaporator compartment into the inlet to provide a constant stream of circulating air across the top of the product compartment when the fan is operating sufficient to provide an air curtain insulating the product compartment from ambient air and maintaining the product in a cool condition with minimum heat loss due to the relatively short distance between the inlet and outlet defining de air curtain as compared to the height of the product compartment.

2. A merchandiser as defined in claim 1, wherein:

the distance between the front and rear walls being about one half of the distance between the access opening and the bottom wall.

3. A merchandiser as defined in claim 1, wherein:

the distance between the front and rear walls is about one half of the distance between the end walls.

4. A merchandiser as defined in claim 1, wherein:

the evaporation compartment communicates with the product compartment and includes a vertical panel adjacent the rear wall having a plurality of vents defining the upper outlet.

5. A merchandiser as defined in claim 1, wherein:

the air circulation passage includes a vertical panel disposed adjacent the front wall and having a plurality of perforations defining the upper inlet.

6. A merchandiser as defined in claim 5, wherein:

the air circulation passage includes a horizontal panel disposed adjacent the bottom wall.

7. A merchandiser as defined in claim 1, wherein:

a product holding rack adapted to receive bottle containers is disposed in said insulated product compartment including a plurality of vertical partitions extending substantially from the bottom wall to the access opening.

8. A merchandiser as defined in claim 7, wherein:

said vertical partitions are provided by grills held in spring biased relation within said product compartment.

9. A merchandiser as defined in claim 7, wherein:

said product holding rack includes an inclined grill for holding bottle containers in inclined relation within said product compartment.

10. A merchandiser as defined in claim 7, wherein:

said product holding rack includes a vertical U-shaped grill disposed adjacent said rear wall and having an opening providing access to said fan compartment.

11. A merchandiser as defined in claim 1, wherein:

a product holding rack is disposed in said insulated product compartment adapted to hold a plurality of vertical columns of bottles in single depth rows inclined to the horizontal to facilitate customer removal.

12. A merchandiser with horizontal air curtain comprising:

a front wall, rear wall, opposed ends and a bottom wall defining an insulated beverage compartment having an open access top an evaporator compartment defined in part by a panel adjacent the rear wall and having an evaportator therein, said panel having a plurality of upper vents for discharging a horizontal stream of cooled air across the beverage compartment;

a compressor compartment having a compressor therein supply refrigerant to the evaporator;

a fan compartment disposed below and communicating with the evaporator compartment and having a fan therein;

a bottom air circulation passage disposed below the fan compartment defined in pert by a panel disposed adjacent the bottom wall and communicating with the fan compartment; and a front air circulation passage defined in part by a panel disposed adjacent the front wall and communicating with the bottom passage; said panel having a plurality of perforations at the upper end disposed across from the rear wall vents and sized to receive air from said vents to provide a constant stream of circulating air when the fan is operating to insulate the beverage compartment from ambient air; and a product holding rack is disposed in said insulated product compartment adapted to hold a plurality of vertical columns of bottles in single depth rows inclined to the horizontal to facilitate customer removal.

* * * * *